US007189120B2

(12) United States Patent
Zaderej

(10) Patent No.: US 7,189,120 B2
(45) Date of Patent: Mar. 13, 2007

(54) ELECTRICAL CONNECTOR WITH TERMINAL VIAS

(75) Inventor: Victor Zaderej, St. Charles, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/130,683

(22) Filed: May 16, 2005

(65) Prior Publication Data

US 2006/0258228 A1 Nov. 16, 2006

(51) Int. Cl.
*H01R 24/00* (2006.01)

(52) U.S. Cl. ..... 439/660; 439/931

(58) Field of Classification Search ..... 439/660, 439/931

See application file for complete search history.

(56) References Cited

U.S. PATENT DOCUMENTS 4,157,612 A 6/1979 Rainal
5,088,009 A * 2/1992 Harada et al. ..... 439/931
5,593,322 A 1/1997 Swamy et al.
6,176,744 B1 * 1/2001 Zito et al. ..... 439/660
6,200,146 B1 * 3/2001 Sarkissian ..... 439/931
6,565,364 B1 * 5/2003 Yun ..... 439/71
2004/0058572 A1 3/2004 Fromm et al.

FOREIGN PATENT DOCUMENTS

EP 0 693 796 A1 1/1996
EP 1 128 475 A2 8/2001

* cited by examiner

*Primary Examiner*—Tho D. Ta
(74) *Attorney, Agent, or Firm*—Robert J. Zeitler

(57) ABSTRACT

A connector includes a housing including terminals and isolating legs extending between the terminals. Vias extends through the housing to provide paths from upper and lower surfaces of the terminals. The terminals have upper portions, lower portions and via portions. The upper portions are formed on the upper surfaces of the housing, the lower portions are formed on the lower surfaces of the housing, and the via portions connect the upper portions to the lower portions. The housing is preferably formed in a two-shot molding process.

20 Claims, 6 Drawing Sheets

FIG.8A
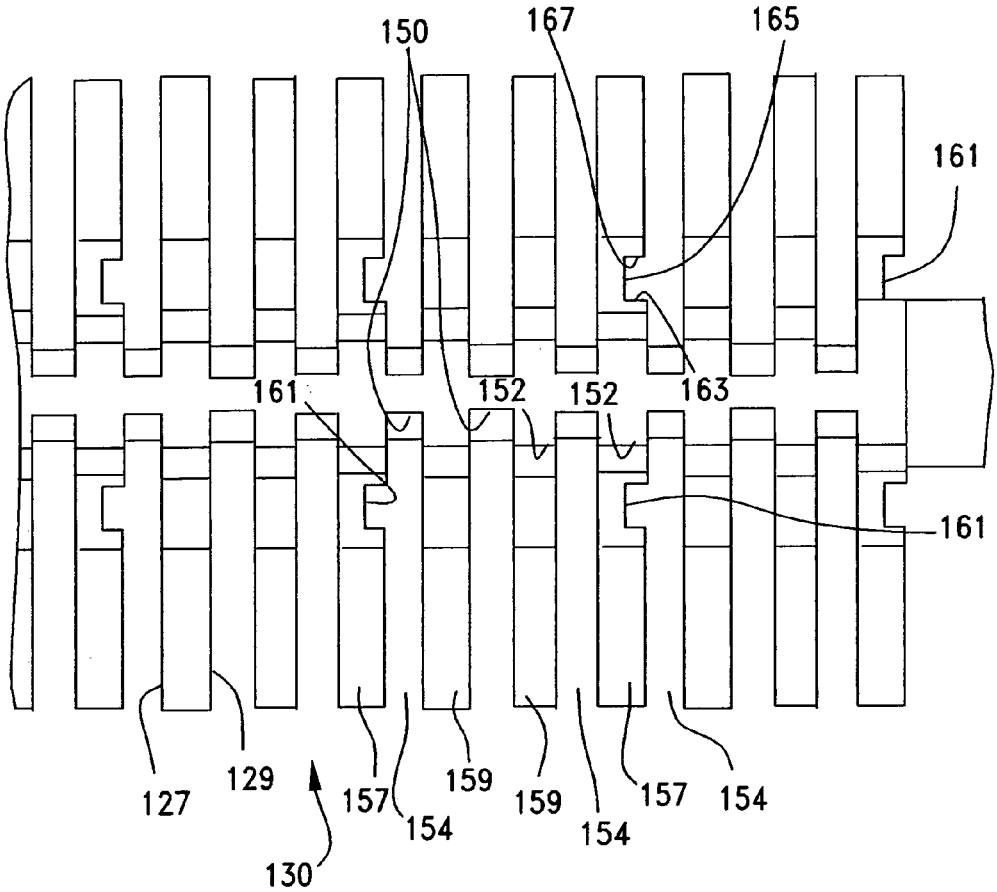
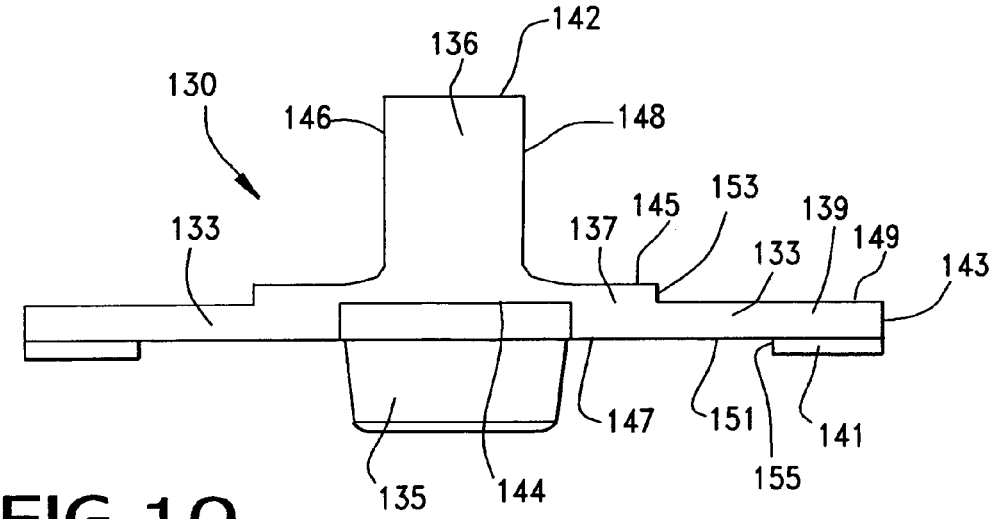
FIG.10

ELECTRICAL CONNECTOR WITH TERMINAL VIAS

FIELD OF THE INVENTION

This invention is generally directed to an electrical connector and, in particular, to an improved electrical connector.

BACKGROUND OF THE INVENTION

Conventional connectors are manufactured using stamped and plated terminals which are inserted into a molded plastic housing. The cost associated with this manufacturing process is high because of the materials used and the number of process steps. The high number of process steps used often makes meeting coplanarity requirements challenging. Because of warping and twisting of the molded parts, the challenge of maintaining coplanarity requirements is exasperated as the connector becomes longer. In addition, expensive machinery is needed to manufacture these types of connectors. For example, high speed stamping dies, molds, reel to reel plating lines, and assembly equipment are needed to manufacture conventional connectors.

SUMMARY OF THE INVENTION

The present invention discloses a connector having a dielectric housing, vias which extend through the housing, and terminals on portions of the housing and through the vias. The connector housing is preferably formed from plateable and nonplateable plastic in a two-shot molding process. The terminals of the connector are formed by plating surfaces the housing. Plated vias provide connection between plating on the upper surfaces of the housing and plating on the lower surfaces of the housing. Thus, the need for insertion of stamped terminals is eliminated. The connector of the present invention overcomes problems presented in the prior art and provides additional advantages over the prior art. Such advantages will become clear upon a reading of the attached specification in combination with a study of the drawings.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 8*a* is a top plan view showing a portion of FIG. 8 in detail;

FIG. 10 is a side elevational view of the first shot molding portion of the housing of FIG. 7.

DETAILED DESCRIPTION OF THE ILLUSTRATED EMBODIMENT

Figure 1:
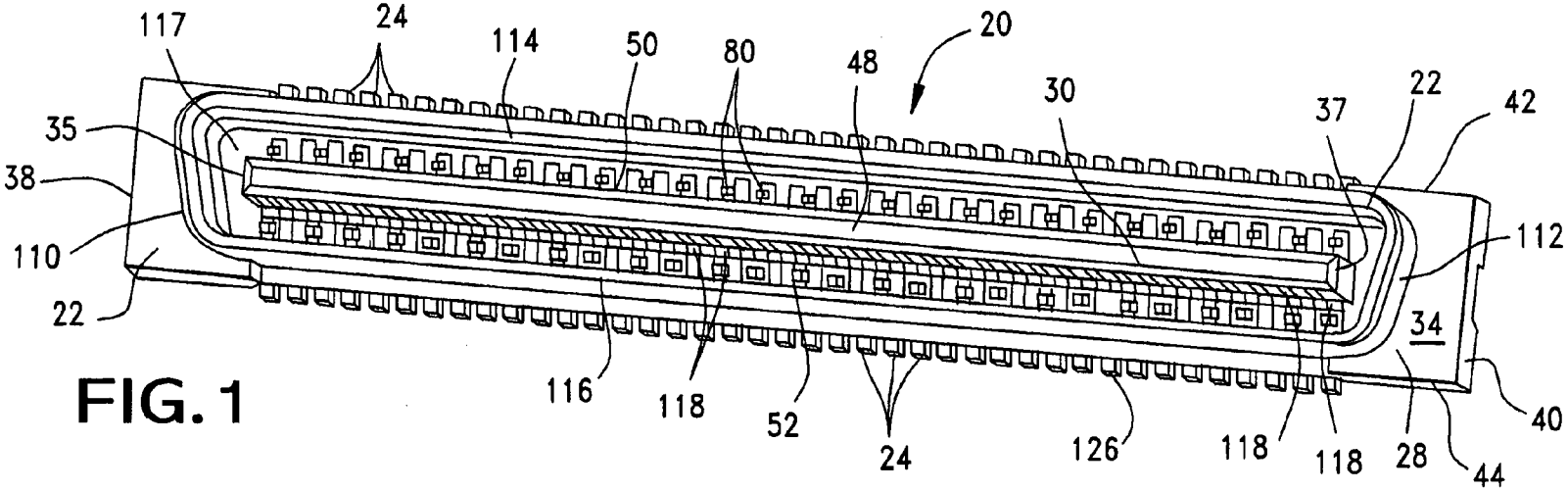
FIG. 1 is a top perspective view of a connector which incorporates features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

An electrical connector 20 is shown in FIGS. 1–6. The electrical connector 20 is a male electrical connector and is designed for mating with a female electrical connector (not shown).

The connector 20 includes a dielectric housing 22, conductive terminals 24 and mounting structures 26. The mounting structures 26 are used to attach the connector 20 to a printed wiring board (not shown). The terminals 24 of the connector 20 mate with the terminals of the female-type electrical connector and with the printed wiring board to provide an electrical path between a device attached to the female-type connector and the printed wiring board.

The housing 22 includes a platform 28, a rib 30 extending upwardly from an upper surface 34 of the platform 28, and a shroud 32 also extending upwardly from the upper surface 34 of the platform 28 and completely encircling the rib 30.

Figures 5, 6:
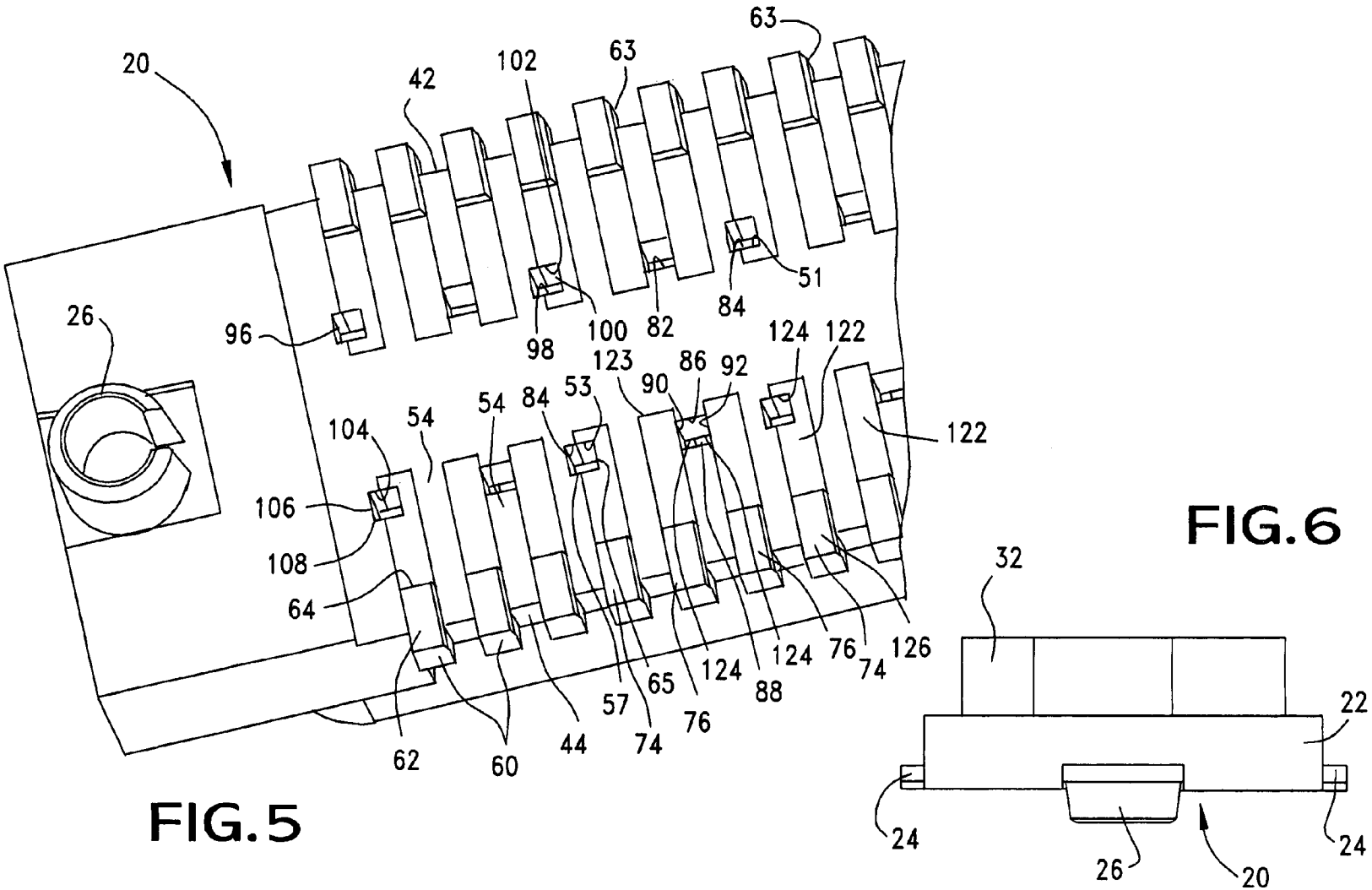
FIG. 5 is a detailed, bottom perspective view of a portion of the connector.
FIG. 6 is a side elevational view of a connector.

The platform 28 includes the upper surface 34, a lower surface 36 (see FIG. 2), a first end surface 38, a second end surface 40, a first side surface 42, a second side surface 44, and two rows of feet 62 (see FIG. 5). As shown, the platform 28 is generally rectangularly-shaped, but other shapes may be provided. The first side surface 42 connects first ends of the end surfaces 38, 40 and the upper and lower surfaces 34, 36. The second side surface 44 connects second ends of the end surfaces 38, 40 and the upper and lower surfaces 34, 36. A first row of the feet 62 is provided along the first side surface 42 and a second row of feet 62 is provided along the second side surface 44. The feet 62 are generally L-shaped and include a first portion 62*a* and a second portion 62*b*. The first portion 62*a* of the feet 62 along the first side surface 42 extend outwardly from the first side surface 42 of the platform 28 and the second portion 62*b* of the feet 62 extend downwardly from the lower surface 36 of the platform 28. The feet 62 along the second side surface 44 extend outwardly from the second side surface 44 of the platform 28 and downwardly from the lower surface 36 of the platform 28. A shoulder 64 is provided between each foot 62 and the lower surface 36 of the platform 28. Each foot 62 includes an end surface 60 which is generally parallel to the first and second side surfaces 42, 44 and extends outwardly beyond the first and second side surfaces 42, 44.

Figure 3:
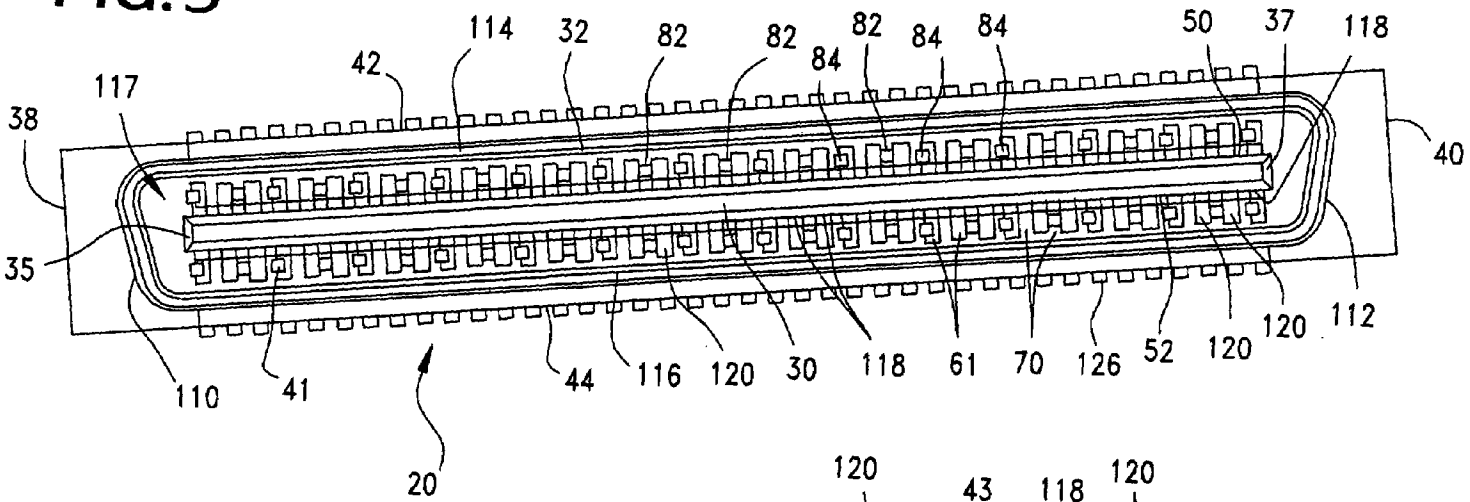
FIG. 3 is a top plan view of the connector.
Figure 3A:
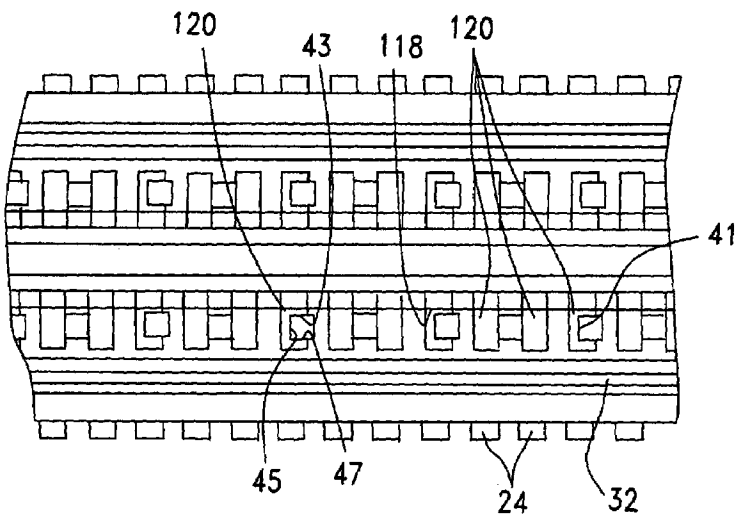
FIG. 3*a* is a detailed top plan view of a portion of the connector.

As best shown in FIGS. 1 and 3, the rib 30 of the housing 22 is positioned on the axial center line of the upper surface 34 of the platform 28. The rib 30 is generally perpendicular to the upper surface 34. The rib 30 is elongated and linear and includes an upper surface 48, a first side wall 50 perpendicular thereto, a second side wall 52 generally parallel to the first side wall 50, a first end wall 35, and a second end wall 37. The first and second side walls 50, 52 extend from the upper surface 48 to the upper surface 34 of the platform 28 and between the first and second end walls 35, 37. The shroud 32 extends upwardly from the upper surface 34 of the platform 28 and is generally perpendicular thereto. The shroud 32 includes a first end portion 110 spaced from the first end surface 38 of the platform 28 and from the first end wall 35 of the rib 30, a second end portion 112 spaced from the second end surface 40 of the platform 28 and from the second end wall 37 of the rib 30, a first side portion 114 spaced from the first side surface 42 of the platform 28 and from the first side wall 50 of the rib 30, and a second side portion 116 spaced from the second side surface 44 of the platform 28 and from the second side wall 52 of the rib 30. The first and second side portions 114, 116 of the shroud 32 are parallel to each other. The first side portion 114 of the shroud 32 is longer than the second side portion 116 to provide a polarizing effect so as to prevent improper mating of the male connector 20 to the complementary connector as described herein.

Figure 4:
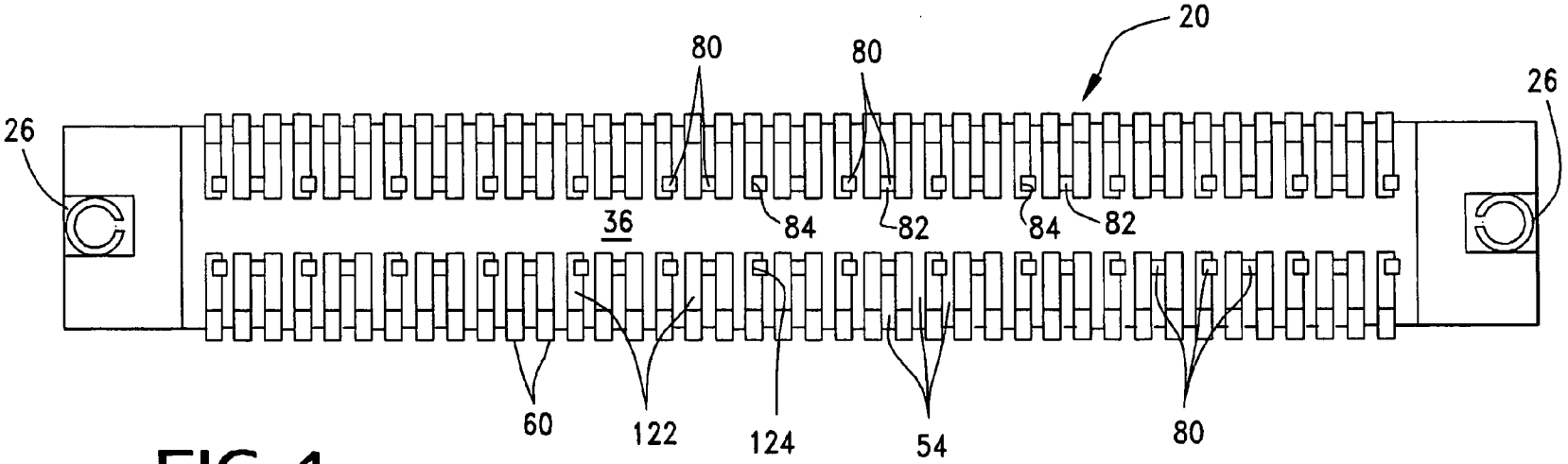
FIG. 4 is a bottom plan view of the connector.

As best shown in FIGS. 3–5, a plurality of spaced apart vias 80 are provided through the platform 28 and extend from the upper surface 34 of the platform 28 to the lower surface 36 of the platform 28. As best shown in FIG. 1, an upper end of the vias 80 are positioned between the rib 30 and the shroud 32. As best shown in FIG. 5, a lower end of the vias 80 are positioned a predetermined distanced from the end surfaces 60. A first row of vias 80 is provided between the first side wall 50 of the rib 30 and the first side portion 114 of the shroud 32. A second row of vias 80 is provided between the second side wall 52 of the rib 30 and the second side portion 116 of the shroud 32.

As shown in FIG. 5, each via 80 includes an inner wall 86, an outer wall 88, a first side wall 90 and a second side wall 92. The inner wall 86 is spaced outwardly from the rib 30 and is generally parallel to the rib 30. The outer wall 88 is spaced from the inner wall 86 and is generally parallel thereto. The first side wall 90 extends from first ends of the inner and outer walls 86, 88 and the second side wall 92 extends from the second end of the inner and outer walls 86, 88. The first and second side walls 90, 92 are perpendicular to the inner and outer walls 86, 88. It is to be understood that the vias 80 can take other forms, for example, hexagonal.

A number of the vias 80 are designated signal vias 82 and a number of the vias 80 are designated ground vias 84. The first and second rows of vias 80 are arranged to provided a pattern of alternating signal vias 82 and ground vias 84.

The shroud 32 defines a mating region 117 in which the terminals 24 of the connector 20 are mated with the terminals of the complementary connector. The conductive terminals 24 are metallized. The terminals 24 extend over portions of the platform 28 and through the vias 80 and are positioned to mate with corresponding terminals of the female-type connector and with the printed wiring board. The terminals 24 include ground terminals 74 and signal terminals 76. As shown, the ground and signal terminals 74, 76 are arranged in a ground-signal-signal-ground pattern. Thus, a pair of signal terminals 76 is provided between two ground terminals 74. The signal terminals 76 of each pair are provided on opposite sides of each signal via 82. Each ground terminal 74 contacts a ground via 84. Other combinations of ground and original terminals are also contemplated.

Each terminal 24 includes a rib portion 118, an upper portion 120, a lower portion 122, and a via portion 124 connecting the upper portion 120 to the lower portion 122.

The rib portion 118 of each terminal 24 is generally rectangularly-shaped and extends from the upper surface 48 of the rib 30, along either the first or second side wall 50, 52 of the rib 30 to the platform 28. Each rib portion 118 is spaced from the next adjacent rib portion 118 such that portions of the dielectric rib 30 are provided therebetween. Each rib portion 118 of each signal terminal 76 is positioned such that an edge of the rib portion 118 is spaced inwardly from a first side wall 90 or a second sidewall 92 of a via 80. Each rib portion 118 of each ground terminal 74 is positioned such that a portion of the rib portion 118 is spaced inwardly from the inner wall 86 of the via 80. Each rib portion 118 mates with a terminal from the complementary connector to which the connector 20 is mated.

As best shown in FIGS. 1 and 3, the upper portion 120 of each terminal 24 is generally rectangularly-shaped and extends from the rib portion 118, along the upper surface 34 of the platform 28 to predetermined distance spaced from the shroud 32. The upper portion 120 extends past the vias 80.

The upper portion 120 of each ground terminal 74 intersect a ground via such that a notch 41 is formed. The notch 41 corresponds to a portion of the upper end of the ground via 84 contacted by the upper portion 120 such that a first edge 43, a second edge 45 and a third edge 47 are defined. The first edge 43 aligns with the upper edge of the inner wall 86 of the via 84, but does not extend the entire length of the inner wall 86. The second edge 45 aligns with the upper edge of the second side wall 92 of the via 84 and extends the entire length of the second side wall 92. The third edge 47 aligns with the upper edge of the outer wall 88 of the via 84 but does not extend the entire length of the outer wall 88.

The upper portion 120 of each signal terminal 26 extends along side a signal via 82 such that the upper portion 120 contacts either the first side wall 90 or the second side wall 92 of the signal via 82.

Figure 2:
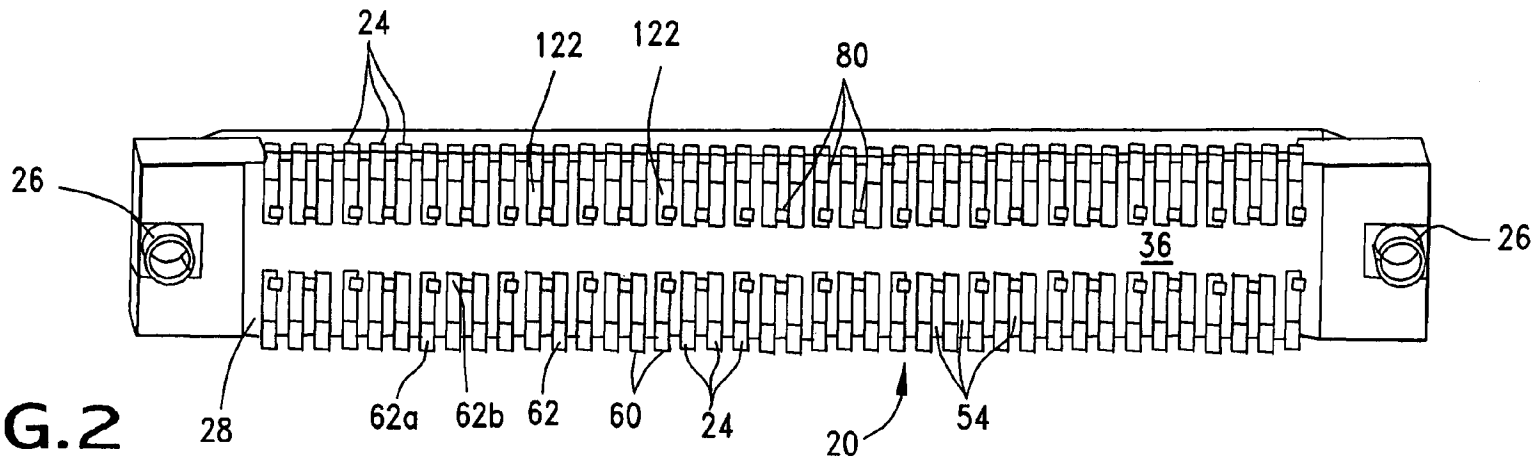
FIG. 2 is a bottom perspective view of the connector.

As best shown in FIGS. 2, 4 and 5, the lower portion 122 of each terminal 24 is also generally rectangularly-shaped and extends along the lower surface 36 of the platform 28. The lower portion 122 extends from the end surface 60 of each foot 62, over the lower surface of the foot 62 to an inner end 123. Each inner end 123 is positioned a predetermined distance from the foot 62, but is positioned inwardly of the vias 80. The lower portion 122 of the terminal 24 contacts the printed wiring board to which the connector 20 is mounted.

The lower portion 122 of each ground terminal 74 intersect a ground via 84 such that a notch 51 is formed. The notch 51 corresponds to a portion of the lower end of the ground via 84 contacted by the lower portion 122 such that a first edge 53, a second edge 55 and a third edge 57 are defined. The notch 51 is positioned below the notch 41 in the upper portion 120. The first edge 53 aligns with the lower edge of the inner wall 86 of the via 84, but does not extend the entire length of the inner wall 86. The second edge 55 aligns with the lower edge of the second side wall 92 of the via 84 and extends the entire length of the second side wall 92. The third edge 57 is aligns with the lower edge of the outer wall 88 of the via 84, but does not extend the entire length of the outer wall 88.

The lower portion 122 of each signal terminal 26 extends along side a signal via 82 such that the lower portion 120 contacts either the first side wall 90 or the second side wall 92 of the signal via 82.

The via portion 124 of each terminal 24 extends along walls of a via 80 to connect the upper portion 120 of each terminal 24 to the lower portion 122 of each terminal 24.

The via portion 124 of each ground terminal 74 extends through a ground via 84 and includes a first wall 98, a second wall 100, and a third wall 102. The first wall 98 extends from the first edge 43 of the notch 41 in the upper portion 120 to the first edge 53 of the notch 51 in the lower portion 122. The second wall 100 extends from the second edge 45 of the notch 41 in the upper portion 120 to the second edge 55 of the notch 51 in the lower portion 122. The third wall 102 extends from the third edge 47 of the notch 41 in the upper portion 120 to the third edge 57 of the notch 51 in the lower portion 122.

The via portion 124 of each signal terminal 76 extends through a signal via 82 and along either the first or second side wall of the signal via 82 depending upon which signal terminal of the pair of signal terminals the via portion belongs to. Thus, the via portion of a first signal terminal 76 extends along the first side wall 90 of a signal via 82 to join the upper surface 120 of the first signal terminal 76 to the lower surface 122 of the first signal terminal 76; and the via portion 124 of a second signal terminal 76 extends along the second side wall 92 of the same signal via 82 to join the upper surface 120 of the second signal terminal 76 to the lower surface 122 of the second signal terminal 76. As best shown in FIG. 5, the via portions 124 of two adjacent signal terminals 76 are provided along a single signal via 82. Thus, the via portion 124 of a first signal terminal 76 is provided along the first side wall 90 of the signal via 82 and via portion 124 of a second signal terminal 76 is provided along second side wall 92 of the signal via 82. The proximity of the via portion 124 of the first signal terminal 76 and the via portion 124 of the second signal terminal 76 provides coupling of the electrical signals carried on each of the signal terminals 76 through the air in the via 82. Thus, a differential pair of signal terminals 76 is provided.

As best shown in FIGS. 2, 4 and 5, the platform 28 provides a plurality of isolating portions 54 extending between the terminals 24. A first row of isolating portions 54 is provided between the first wall 50 of the rib 30 and the first side surface 42 of the platform and a second row of isolating portions 54 is provided between the second wall 52 of the rib 30 and the second side surface 44 of the platform. The isolating portions 54 and the terminals 24 are arranged such that an isolating portion 54 is provided on either side of each terminal 24. The isolating portions 54 are interrupted by the signal and ground vias 82, 84.

An electrical path is provided by each terminal 24 which extends from the rib portion 118, to the upper portion 120, to the via portion 124, and to the lower portion 122. In the case of adjacent signal terminals, the electrical paths of adjacent signal terminals are coupled through the signal via 82 between the signal terminals to create a differential signal pair. Each signal terminal 24 of the pair carries a signal which is 180 degrees out of phase with the adjacent signal terminal 24 and, therefore, provides for the elimination of noise from the transmitted signal.

Preferably, the housing 22 of the electrical connector 20 is formed using a two-shot molding process. A plateable plastic, preferably one including a palladium catalyst, is used in the first shot of the two-shot molding process, to form a plateable portion 130 as shown in FIGS. 7–10. A non-plateable plastic is then used in the second shot of the two-shot molding process to form a non-plateable portion which is molded over portions of the plateable portion 130 to form the housing 22, as shown in FIGS. 1–6. Thus, after the second shot, portions of the plateable portion 130 remain exposed. The housing 22 is then etched and placed in a metal bath, preferably a copper bath, so the exposed portions of the plateable portion 130 are plated to form the terminal 24.

Figure 7:
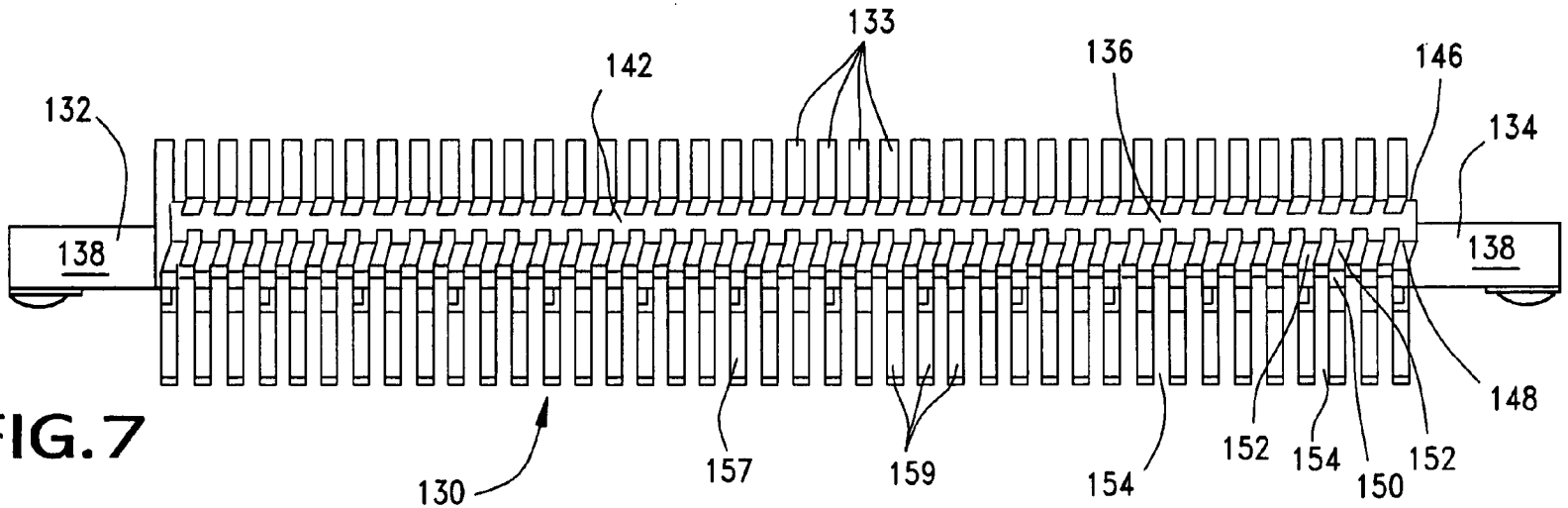
FIG. 7 is a top perspective view of the first shot molding portion of the housing which is used to form the connector of FIGS. 1–6.

As best shown in FIGS. 7 and 10, the plateable portion 130 is generally elongated and T-shaped. The plateable portion 130 includes a first end portion 132, a second end portion 134, a rail 136, terminal shafts 133, and mounting structures 135.

The first and second end portions 132, 134 are generally rectangularly-shaped and planar. Each of the end portions 132, 134 has an upper surface 138 and a lower surface 140. The mounting structures 135 extend downwardly from the lower surfaces 140 of the end portions 132, 134. The mounting structures 135 are generally elongated and C-shaped.

Figure 8:
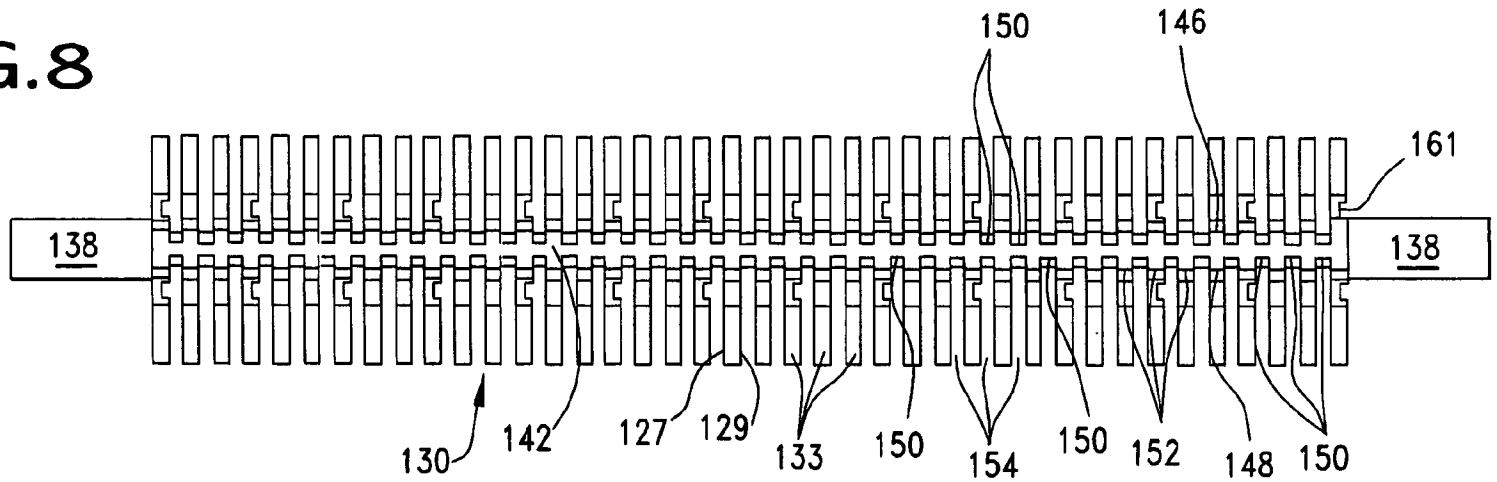
FIG. 8 is a top plan view of the first shot molding portion of the housing of FIG. 7.
Figure 9:
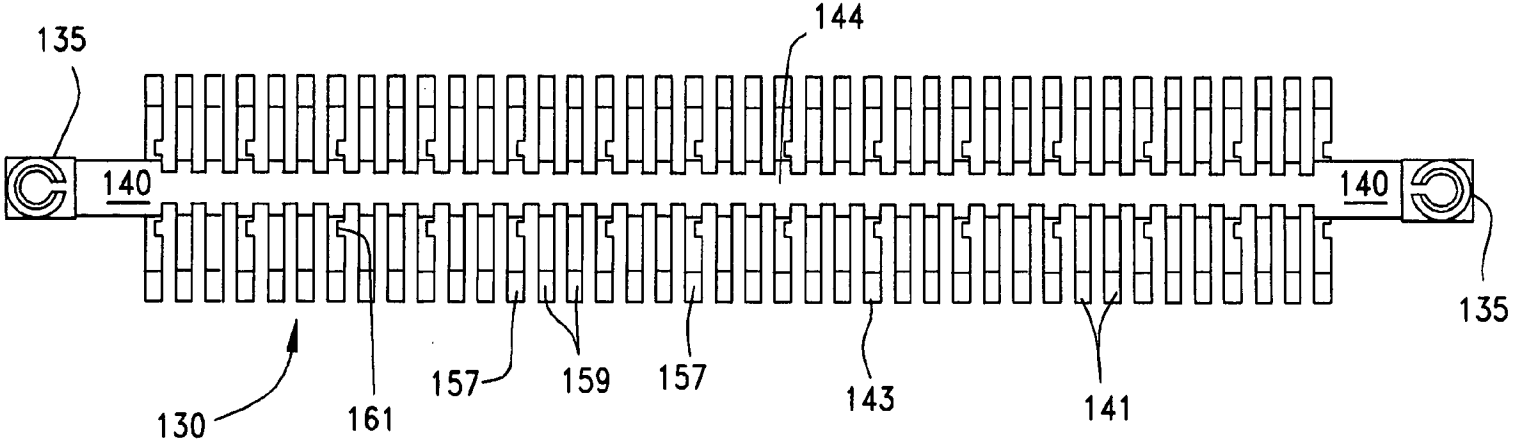
FIG. 9 is a bottom plan view of the first shot molding portion of the housing of FIG. 7.

The rail 136 is generally rectangularly-shaped. The rail 136 extends from the first end portion 132 to the second end portion 134 and is generally perpendicular to the end portions 132, 134. The rail 136 includes an upper surface 142, a lower surface 144, a first side wall 146 and a second side wall 148. The first and second side walls 146, 148 extend from the upper surface 142 to the lower surface 144 and are generally perpendicular to the upper and lower surfaces 142, 144. A plurality of channels 150, see FIGS. 7 and 8, are formed along the first and second side walls 146, 148 of the rail 136 and extend from the upper surface 142 to the lower surface 144. A plurality of vertical mating surfaces 152 are provided by the portions of the side walls 146, 148 adjacent the channels 150.

The terminal shafts 133 extend outwardly from opposite sides of the rail 136 and from 152. A first row of shafts 133 extends outwardly from the first side wall 146 of the rail 136 and a second row of shafts 133 extends outwardly from the second side wall 148 of the rail 136. The shafts 133 are spaced apart from each other in each row such that a gap 154 is formed between adjacent shafts 133. The gaps 154 are aligned with the channels 150.

As best shown in FIG. 10, each shaft 133 includes a first section 137, a second section 139, and a foot 141. The first section 137 includes an upper surface 145 and a lower surface 147. The second section 139 includes an upper surface 149, a lower surface 151, and a free end 143. The second section 139 extends from the first section 137, such that a shoulder 153 is provided between the first and second sections 137, 139. The second section 139 has less height than the first section 137. The upper surface 145 of the first section 137 is parallel to, but not planar with, the upper surface 149 of the second section 139. The foot 141 extends from the lower surface 151 of the second section 139 proximate the free end 143 thereof. A shoulder 155 is provided between the foot 141 and the second section 139 of the shaft 133. After the second shot, the upper surface 145 of the first section 137 will provide the surface on which the upper portion 120 of the terminal 24 will be formed; the lower surfaces 147, 151 will provided the surface on which the lower portion 122 of the terminal 24 will be formed, and the feet 141 will become the feet 62.

Each shaft 133 is designated a ground shaft 157 or a signal shaft 159. The ground shafts 157 and the signal shafts 159 are arranged in a ground-signal-signal-ground pattern. Thus, a pair of signal shafts 159 is provided between two ground shafts 157, see FIG. 8*a*.

Each ground shaft 157 includes a notch 161 in the first section 137 of the shaft 157. Each notch 161 includes a first wall 163, a second wall 165, and a third wall 167. The first wall 163 is spaced from the rail 136 and is generally parallel to the rail 136. The third wall 167 is spaced outwardly from the first wall 163 and is generally parallel to the first wall 163. The second wall 165 extends from the first wall 163 to the third wall 167 and is generally perpendicular to the first and third walls 163, 167. Each notch 161 is in communication with a gap 154. After the second shot, the first wall 163 will become the portion of the via 84 on which the first wall 98 of the via portion 124 of the ground terminal 74 will be provided; the second wall 165 will become the portion of the via 84 on which the second wall 100 of the via portion 124 of the ground terminal 74 will be provided; and the third wall 167 will become the portion of the via 84 on which the third wall 102 of the via portion 124 of the ground terminal 74 will be provided.

Each signal shaft 159 includes a first side wall 127 and a second side wall 129 extending outwardly from the rail 136 to the free end 143 of the shaft 159.

After formation of the plateable portion 130, the second shot of the molding process is performed and the non-plateable portion of the housing 22 is formed over portions of the plateable portion 130 to form the housing 22.

The rib 30 is formed by providing non-plateable plastic over portions of the rail 136. More specifically, non-platable plastic is provided over the upper surface 142 of the rail 136 to form the upper surface 48 of the rib 30. Non-plateable plastic is provided within the channels 150 of the rail 136 and the vertical mating surfaces 152 of the rail 136 remain exposed to form the first and second side walls 50, 52 of the rib 30.

The platform 28 is formed by providing non-plateable plastic over the upper and lower surfaces 138, 140 of the first and second end portions 132, 134, but not over the mounting structures 26; by providing non-platable plastic over portions of the terminal shafts 133 of the plateable portion 130; and by providing non-plateable plastic in the gaps 154 between the terminal shafts 133 to form the isolating portions 54 of the housing 22. The notches 161 of the ground shafts 157 of the plateable portion 130 align with the notches 96 formed with the isolating portions 54 to form the ground vias 84. In particular, inner wall 163 of the plateable portion 130 aligns with inner wall 104 formed by the non-plateable plastic, and outer wall 167 of the plateable portion 130 aligns with outer wall 108 formed by the non-plateable plastic. The signal vias 82 are also formed with the isolating portions 54 and extend from a first signal shaft 157 of the plateable portion 130 to a second signal shaft 157 of the plateable portion 130.

The shroud 32 is formed by providing non-platable plastic over the shafts 133 of the platable portion 130 and over the isolating portions 54. The shroud 32 extends from the shoulders 153 of the shafts 133, along the upper surfaces 149 of the second portions of the shafts 133, toward the free ends 60 of the shafts 133 but is spaced from the free ends 60 of the shafts 133.

Formation of the housing 22 using the two shot molding process as described above provides exposed portions of the plateable portion 130. The exposed portions of the plateable portion 130 include the vertical mating surfaces 152 along the first and second side walls 146, 148 of the rail 136, the upper surfaces 145 of the first portions 137 of the terminal shafts 133, portions of the upper surfaces 149 of the second portions 139, the lower surfaces 151 of the second portions 139 of the terminal shafts 133, the lower surfaces of the feet 141 of the terminal shafts 133, the first, second and third walls 163, 165, 167 of the notches 161 in the ground shafts 157 and the portions of the first and second side walls 127, 129 of the signal shafts 159 which form the signal vias 82.

When the exposed portions of the plateable portion 130 are etched and placed in the metal bath, preferably a copper bath, the exposed portions are plated. More specifically, the rib portion 118 of each terminal 24 is formed on the vertical mating surfaces 152 along the first and second side walls 146, 148 of the rail 136; the upper portion 120 of each terminal 24 is formed on the upper surfaces 145 of the first portions 137 of the terminal shafts; the lower portion 122 of each terminal 24 is formed on the lower surfaces 151 of the second portion 139 of the terminal shafts 133 and on the lower surfaces of the feet 141 of the terminal shafts 133; the via portion 124 of each ground terminal 74 is formed on the first, second and third walls 163, 165, 167 of the notches 161 in the ground shafts 157; and the via portions of each signal terminal 76 is formed on either a portion of the first or second side wall 127, 129 of the signal shafts 159. Thus, plating of the exposed portions of the plateable portion 130 results in the formation of the terminals 24 which are used to mate the connector 20 with a complementary connector to provide an electrical connection between the terminals of the complementary connector and the printed wiring board to which the connector 20 is mounted.

As described, by using the two-shot molding process, the connector 20 can be manufactured without the insertion of stamped metal terminals into a housing. By plating portions of the plateable housing 22 rather than inserting terminals into a housing, tolerance issues between the housing 22 and terminals 24 are eliminated. In addition, co-planarity issues between the housing 22 and terminals 24 are eliminated because alignment of the terminals 24 and the housing 22 is eliminated. In addition, the need for high-speed stamping dies and equipment molds, reel to reel plating lines and assembly equipment is eliminated. Overall, the cost of manufacturing the connector 20 is estimated to be significantly less than the cost of manufacturing a typical connector. In addition, the capital cost requirements associated with the equipment necessary to manufacture the connector 20 are likewise estimated to be significantly less than the capital cost requirement associated with typical connectors.

Another advantage provided by the connector 20 is that when designing the layout of the connector 20, the designer can select the placement of the signal vias 82, and therefore, can elect to couple some signal terminals 76 while allowing other signal terminals 76 to remain un-coupled. In the event two adjacent signal terminals 76 are not to be coupled, the signal via 82 can be formed such that it does not extend to the adjacent signal terminal 76. The signal via 82 could also be formed in a manner similar to the ground via 84 by providing a notch in the shaft 133 and a notch in the adjacent isolating portion 54.

Although the ground vias 84 have been described as being formed partially through a ground terminal shaft 74 and partially through the adjacent isolating portion 54, it is to be understood that the ground via 84 could be formed through only the ground terminal shaft 74.

Although a two-shot molding process has been described to form the connector 20, it is to be understood that the connector 20 can be formed without using a two-shot molding process. Formation of the terminals 24 can be accomplished by placing the rib portion 118 of the terminals 24 along the rib 30, placing the upper portion 120 along the upper surface of the platform 28, placing the lower portion 122 of the terminal 24 along the lower surface of the platform 28, and placing the via portion 124 within the vias 80. By forming the terminals 24 in this manner, the amount of metal used to form the terminals 24 is reduced, resulting in a cost savings.

Finally, the via structure described is necessary for the disclosed connector as there does not exist another means of getting the signal or ground terminals from the rib to the lower surface/feet due to the shroud structure. In other words, the metallized terminal traces cannot travel along the shroud to get from the rib to the lower surface/feet.

While a preferred embodiment of the present invention is shown and described, it is envisioned that those skilled in the art may devise various modifications of the present invention without departing from the spirit and scope of the appended claims.

What is claimed is:

1. A connector for mounting on a printed wiring board and for mating to a complementary connector comprising:

a housing formed from a dielectric material having upper surface and lower surfaces thereof and a plurality of vias through said housing providing a path from said upper surface of said housing to said lower surface of said housing, said vias being surrounded by said housing; and a plurality of terminals mounted to said housing, each said terminal including an upper portion positioned on said upper surface of said housing, a lower portion positioned on said lower surface of said housing, and a via portion extending through said via and connecting said upper portion to said lower portion, wherein the via portion is formed by metallizing the via, wherein said housing further includes a rib having first and second walls on opposing sides of the rib extending upwardly from said upper surface of said housing, each of said plurality of terminals includes a rib portion which is capable of extending on either the first wall or the second wall of said rib and said rib portion of each of said plurality of terminals contacts said upper portion of each of said plurality of terminals.

2. A connector as defined in claim 1, wherein said at least one via is positioned between a first signal terminal and a second signal terminal and said via extends from said first signal terminal to said second signal terminal; and wherein said via portion of said first signal terminal and said via portion of said second signal terminal extend through the same via.

3. A connector as defined in claim 1, wherein the upper portion of each of said plurality of terminals includes a notch aligned with a portion of said via, the lower portion of each of said plurality of terminals includes a notch aligned with a portion of said via, and said via portion of each of said plurality of terminals contacts said notch of said upper portion and said notch of said lower portion.

4. The connector as defined in claim 1, wherein said housing further includes a plurality of feet extending from the lower surface of said housing and said lower portion of each said terminal extends over one of said plurality of feet.

5. The connector of claim 1, wherein said housing further includes mounting structures extending from the lower surface of said housing for mounting said connector to the printed wiring board.

6. The connector of claim 1, wherein said housing further includes a shroud extending upwardly from said upper surface of said housing and encircling said rib.

7. The connector of claim 6, wherein said vias are positioned between said rib and said shroud.

8. An electrical connector, comprising:

a housing formed from a dielectric material having upper surface and lower surfaces thereof and a plurality of vias through said housing providing a path from said upper surface of said housing to said lower surface of said housing, said vias being surrounded by said housing; and a plurality of terminals mounted to said housing, each said terminal including an upper portion positioned on said upper surface of said housing, a lower portion positioned on said lower surface of said housing, and a via portion extending through said via and connecting said upper portion to said lower portion, wherein the via portion is formed by metallizing the via, wherein the upper portion of each of said plurality of terminals includes a notch aligned with a portion of said via, the lower portion of each of said plurality of terminals includes a notch aligned with a portion of said via, and said via portion of each of said plurality of terminals contacts said notch of said upper portion and said notch of said lower portion.

9. The connector as defined in claim 8, wherein said housing further includes a plurality of feet extending from the lower surface of said housing and said lower portion of each said terminal extends over one of said plurality of feet.

10. The connector as defined in claim 8, wherein said housing further includes mounting structures extending from the lower surface of said housing for mounting said connector to the printed wiring board.

11. The connector as defined in claim 8, wherein said housing further includes a rib having first and second walls extending upwardly from said upper surface of said housing; each of said plurality of terminals includes a rib portion which extends along the first or second wall of said rib; and said rib portion of each of said plurality of terminals contacts said upper portion of each of said plurality of terminals.

12. The connector as defined in claim 11, wherein said housing further includes a shroud extending upwardly from said upper surface of said housing and encircling said rib.

13. The connector as defined in claim 12, wherein said vias are positioned between said rib and said shroud.

14. A connector for mounting on a printed wiring board and for mating to a complementary connector comprising:

a housing formed from a dielectric material having upper surface and lower surfaces thereof and a plurality of vias through said housing providing a path from said upper surface of said housing to said lower surface of said housing, said vias being surrounded by said housing; and a plurality of terminals mounted to said housing, each said terminal including an upper portion positioned on said upper surface of said housing, a lower portion positioned on said lower surface of said housing, and a via portion extending through said via and connecting said upper portion to said lower portion, wherein the via portion is formed by metallizing the via, wherein said at least one via is positioned between a first signal terminal and a second signal terminal and said via extends from said first signal terminal to said second signal terminal and wherein said via portion of said first signal terminal and said via portion of said second signal terminal extend through the same via.

15. A connector as defined in claim 14, wherein the upper portion of each of said plurality of terminals includes a notch aligned with a portion of said via, the lower portion of each of said plurality of terminals includes a notch aligned with a portion of said via, and said via portion of each of said plurality of terminals contacts said notch of said upper portion and said notch of said lower portion.

16. The connector as defined in claim 14, wherein said housing further includes a plurality of feet extending from the lower surface of said housing and said lower portion of each said terminal extends over one of said plurality of feet.

17. The connector as defined in claim 14, wherein said housing further includes mounting structures extending from the lower surface of said housing for mounting said connector to the printed wiring board.

18. The connector as defined in claim 14, wherein said housing further includes a rib having first and second walls extending upwardly from said upper surface of said housing; each of said plurality of terminals includes a rib portion which extends along the first or second wall of said rib; and said rib portion of each of said plurality of terminals contacts said upper portion of each of said plurality of terminals.

19. The connector as defined in claim 18, wherein said housing further includes a shroud extending upwardly from said upper surface of said housing and encircling said rib.

20. The connector as defined in claim 19, wherein said vias are positioned between said rib and said shroud.

* * * * *